United States Patent [19]

Moussy et al.

[11] Patent Number: 4,566,541

[45] Date of Patent: Jan. 28, 1986

[54] PRODUCTION TUBES FOR USE IN THE COMPLETION OF AN OIL WELL

[75] Inventors: Jacques L. Moussy, Boulogne; Jean A. Lescoeur, Paris, both of France

[73] Assignee: Compagnie Francaise des Petroles, Paris, France

[21] Appl. No.: 660,671

[22] Filed: Oct. 15, 1984

[30] Foreign Application Priority Data

Oct. 19, 1983 [FR] France ..... 83 16613

[51] Int. Cl.[4] ..... E21B 34/10; E21B 34/14

[52] U.S. Cl. ..... 166/318; 166/317; 166/194; 251/341

[58] Field of Search ..... 166/194, 154, 317, 318, 166/332, 373–374, 386; 137/515; 251/341, 342, 348, 57, 58

[56] References Cited

U.S. PATENT DOCUMENTS

| | | | |
|---|---|---|---|
| 2,447,842 | 8/1948 | Cameron et al. | 137/515 |
| 3,120,269 | 2/1964 | Evans et al. | 166/318 |
| 3,275,080 | 9/1966 | Nelson et al. | 137/515 |
| 3,995,692 | 12/1976 | Seitz | 166/318 |
| 4,154,303 | 5/1979 | Fournier | 166/318 |

*Primary Examiner*—Stephen J. Novosad
*Assistant Examiner*—Bruce M. Kisliuk
*Attorney, Agent, or Firm*—Sughrue, Mion, Zinn, Macpeak and Seas

[57] ABSTRACT

A connector for incorporation in a production tube for an oil well, below the packer, comprises a closing flap which closes when a first retractable ball seat is displaced downwards, in order to provide a safety device during the installation of the well head, and above the flap, a second retractable ball seat which, when it is moved away axially downwards, causes the flap to open and be maintained in the open position, in order to put the well in a state of production. The balls seats are provided in the upper portions of two resiliently radially expandable sleeves and are displaced downwardly by the application of fluid pressure to the space within the production tube above their other closure of the respective seat by a ball dropped on to the seat from above.

5 Claims, 7 Drawing Figures

PRODUCTION TUBES FOR USE IN THE COMPLETION OF AN OIL WELL

The present invention relates to the completion of an oil well, that is to say to the operations for putting a drilled well into a state for producing an effluent, particularly as a result of the installation of a production tube and a well head.

It is known that the operations for the completion of an oil well make it necessary to lower and raise several instruments by means of a cable, particularly in order to test the production tube, anchor the sealing device called a packer, ensuring sealing between the production tube and the casing of the well, ensure the safety of the well during the installation of the well head, introduce a light starting fluid and put the well into production.

There is, at the present time, equipment which makes it possible to carry out some of these operations without the use of a cable. Thus, to anchor a hydraulic packer, it is possible to use a retractable ball seat placed in the production tube under the packer and put the production tube under pressure so as to anchor the packer, excess pressure displacing the ball and the seat, and the latter then moving away to allow the ball to escape. Likewise, a production tube can be tested by the use of a fixed seat blocked by a ball which is subsequently recovered on the surface by means of reverse pumping from the annular space between the production tube and the casing towards the space within the production tube, this presupposing the installation of a circulation valve which establishes communication between the annular space and the space within the production tube at a level near that of the packer. Such a circulation valve can also allow the circulation of a starting fluid, and it is possible to control it by means of the pressure in the annular space.

Apart from the fact that a sealing defect in the circulation valve is always to be feared, and that the control of the latter by means of the pressure in the annular space increases even further the risks of leakage in comparison with a cable control, because it implies communication between the annular space and the space within the production tube, control of the circulation valve by means of the pressure in the annular space is not suitable for the introduction of a starting fluid into the production tube, since pumping must then be carried out from the annular space, which has a large volume.

In any event, the safeguarding of the well during the installation of the well head makes it necessary to block the production tube at a level near that of the packer and, at the present time, this blocking can be carried out only by the use of a cable to fit a plug.

According to the invention there is provided a connector for insertion in a production tube for use in the completion of an oil well by installation in a casing of the oil well, the production tube being provided with a sealing device, called a packer, to close the annular space between the production tube and casing, and by installation of a well head for production purposes, the connector being intended to be inserted in the production tube below the packer and comprising a first retractable ball seat which, when closed by a ball, makes it possible to admit a pressurised fluid into the inner space within the production tube and which is adapted to be moved away as a result of axial displacement and radial expansion under the action of an excess pressure in the inner space, a closing flap arranged so as to close when the first seat is moved away under the action of the said excess pressure, in order to provide a safety device during the installation of the well head, and, above the flap, a second seat which, when closed by a second ball and subjected to a pressurised fluid in the inner space, is adapted to be moved away as a result of axial displacement and radial expansion and to cause the flap to open and be maintained in the open position, in order to put the well in a state of production.

Advantageously the first seat, when closed by a first ball, makes it possible to increase the pressure in the said inner space, first in order to anchor the packer and then in order to test the production tube. When this first seat has been moved away, the flap closes and constitutes a safety device during the operations of assembling the well head. The second seat serves to open the flap before the well is put into production. It is possible in this way to avoid any operation involving the lowering or raising of instruments by means of a cable.

Preferably the connector comprises, from top to bottom in the axial direction, an upper part in which a radially expandable upper sleeve is held radially compressed and is retained vertically by at least one first shearable means; a first middle part, carrying the closing flap, and a second middle part containing a receptacle for receiving said upper sleeve and allowing radial expansion of said upper sleeve; a lower part in which a radially expandable lower sleeve is held radially compressed and is retained vertically by at least one second shearable means, and a lengthening part containing a receptacle for receiving said lower sleeve and allowing expansion of said lower sleeve, said lower sleeve, when radially compressed, providing said first seat, said upper sleeve, when radially compressed, providing said second seat which has a greater diameter than the diameter of said first seat, the presence of either the lower sleeve or the upper sleeve in said first middle part ensuring the opening of said flap, said lower sleeve extending in said first middle part when it is located in said lower part, and said upper sleeve extending in said first middle part when it is located in said second middle part.

The lower and upper sleeves are preferably cylindrical sleeves split along a generating line. The first and second seats are preferably provided in an upper portion of these sleeves. The flap is preferably a folding-down flap.

Other features and advantages of the invention will become apparent from the following description of an embodiment thereof, given by way of example only with reference to the accompanying drawings.

Figure 1:
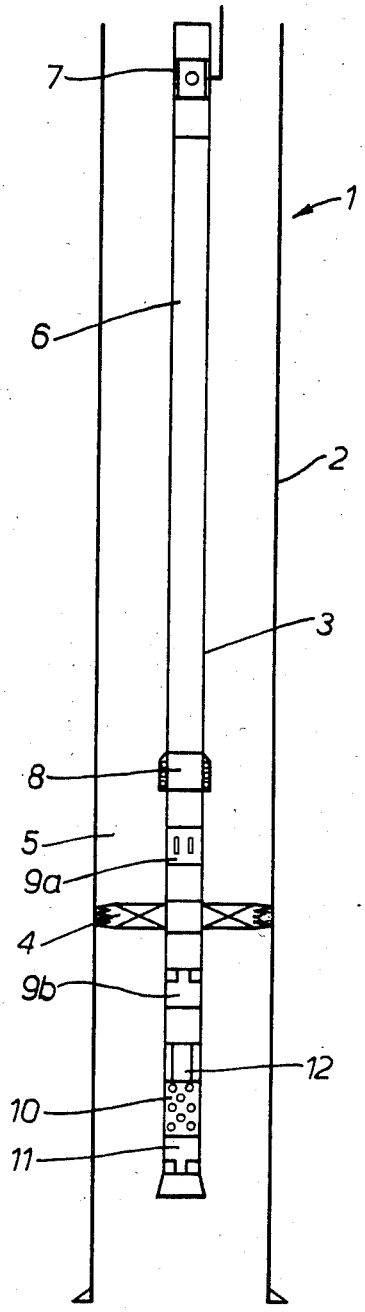
FIG. 1 shows diagrammatically an oil well, the production tube of which is equipped with an embodiment of connector according to the invention.

In FIG. 1 there is shown an oil well 1 delimited by a casing 2, on the inside of which a production tube 3, provided with a hydraulic packer 4, has been lowered in order to close the annular space 5 located in the tube 3 and the casing 2, the effluent being forced to rise in the space 6 within the tube 3.

Neither the head of the production tube, nor the means of suspension of this head, nor the well head have been shown, since these members are conventional and do not relate directly to the subject of the invention.

The production tube 3 comprises conventionally: in its upper part near the land surface, a sub-surface safety valve 7; above the packer 4, an expansion connector 8 and sliding circulation valve 9*a;* under the packer 4, an upper so-called "no-go" stop connector 9*b,* a perforated connector 10 and a lower so-called "no-go" stop connector 11. All the customary members have been retained in this production tube 3, although some of them, such as, for example, the sliding circulation valve 9*a,* are not involved in the completion, without operations involving lowering or raising by means of a cable, which the invention makes it possible to carry out, since they can be used to perform special operations in some cases or when certain anomalies occur.

The production tube 3 differs from a conventional production tube in that a connector 12, which will be described with reference to FIGS. 2 to 7, is inserted underneath the packer 4.

Figure 2:
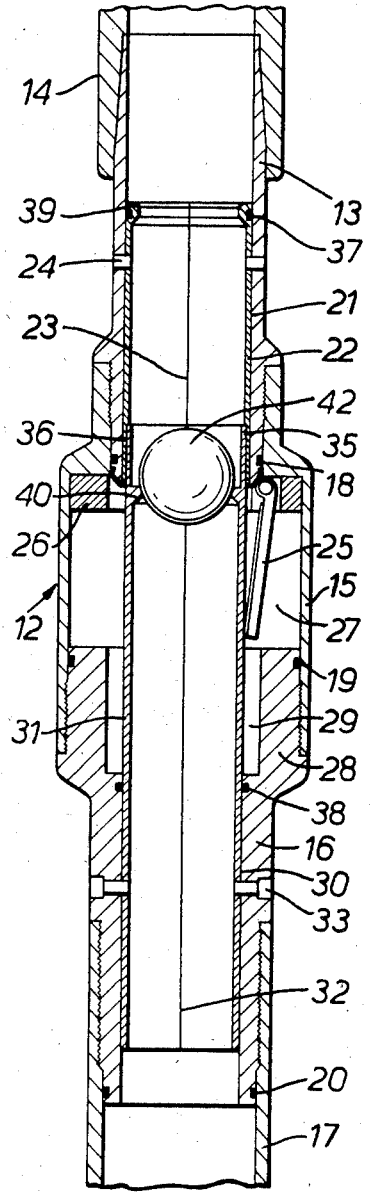
FIG. 2 is an axial section through the connector of FIG. 1 in the state in which the connector is lowered in the well.

In FIG. 2, it will be seen that the connector 12 comprises an envelope formed from an upper body 13 screwed to a bush 14 of the production tube 1, a middle body 15, a lower body 16 and a lengthening body 17. These various bodies are connected to one another by threaded portions, and their connections are made leak-proof by O-ring sealing gaskets 18, 19 and 20.

Figure 3:
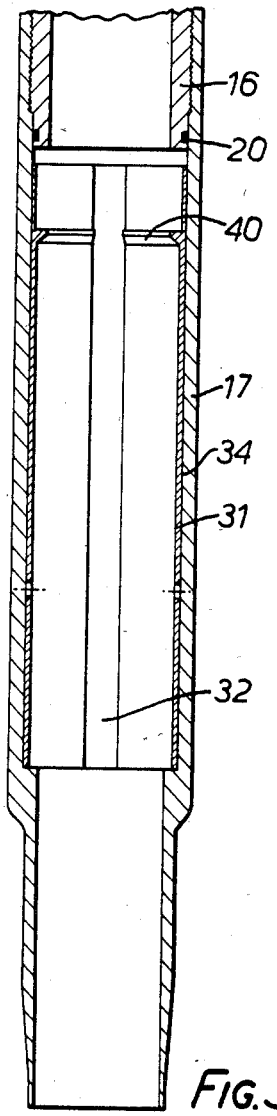
FIG. 3 is an axial section through the lower part of the connector contained in the lengthening part, after the lower sleeve has been lowered.

The interior of the envelope can be considered as forming five successive parts: an upper part delimited by the upper body 13, forming a sheath 21 which maintains radially compressed an upper sleeve 22 which consists of an elastic metal alloy and is split along a generating line 23 and which is retained axially by a shearing pin 24; a first widened middle part delimited by the middle body 15 and serving as the rectacle for a folding-down flap 25 which is mounted on a support 26 and which can open in a space 27 provided by the middle body 15; a second middle part which has an inside diameter of a size between that of the upper part and that of the first middle part and which is delimited by a widened upper portion 28 of the lower body 16 screwed into the middle body 15 and forming an expansion receptacle 29 for the upper sleeve 22; a lower part delimited by the rest of the lower body 16 and forming a sheath 30 maintaining radially compressed a lower sleeve 31 which consists of an elastic metal alloy and is split along a generating line 32 and which is retained axially by a shearing pin 33; and a lengthening part delimited by the lengthening body 17 and forming an expansion receptacle 34 for the lower sleeve 31, as can be seen in FIG. 3.

In the example illustrated, it has been assumed that the lower sleeve 31 and the upper sleeve 22 are fitted into one another over respective cylindrical portions 35 and 36. O-ring sealing gaskets 37 and 38 respectively made of elastomeric material have been inserted between the upper sleeve 22 and the upper body 13 and between the lower sleeve 31 and the lower body 16.

Seats 39 and 40, intended for receiving closing balls 41 (FIG. 5) and 42 (FIG. 2), respectively, are formed in the upper portions of the sleeves 22 and 31 respectively. The seat 39 and the ball 41 have diameters greater than the diameters of the seat 40 and of the ball 42.

Figure 6:
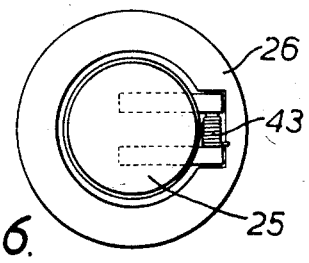
FIG. 6 is a plan view of the closing flap.

At rest, the folding-down flap 25 is brought into the closing position by means of a restoring spring 43, as can be seen in FIG. 6.

The mode of operation of the connector 12 will now be described.

Figure 5:
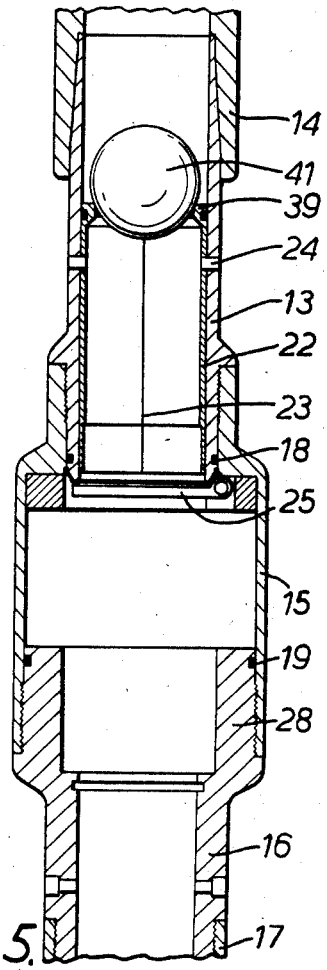
FIG. 5 is an axial section through the part of the connector located above the lower part illustrated in FIG. 3, after the lower sleeve has been lowered.
Figure 4:
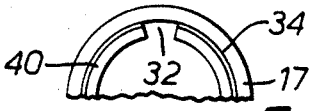
FIG. 4 is a plan view of the lower sleeve in the lengthening part.

The production tube 3 is lowered in the well 1, with the packer 4 retracted and the connector 12 in the position shown in FIG. 2, except that the ball 42 is retained on the surface. After the production tube 3 has been lowered and put in place, a light starting fluid is pumped into the space 6 within the production tube 3, and a sealing test can be conducted on the sub-surface safety valve 7, if the latter is closed and the pressure above it is removed. The ball 42 is then dropped down tube 3 from the surface on to seat 40 to block the lower sleeve 31. The pressure in the space 6 within the tube 3 is then increased first up to a sufficient valve to anchor the packer 4, then to a test value at which the tube 3 is tested, and finally to a shearing value at which the shearing pin 33 is severed, thus allowing the lower sleeve 31 to descend and take its place in the receptacle 34, as shown in FIGS. 3 and 4. The slit 32 then widens because of the elasticity of the lower sleeve 31, and the ball 42 escapes from the seat 40. At the same time, the flap 25, previously kept open because of the presence of the lower sleeve 31 in the space 27, closes, as shown in FIG. 5, thus ensuring, in conjunction with the conventional measures taken at the surface, safety during the subsequent phase involving removal of the well blocking unit (WBU) and assembly of the well head.

Figure 7:
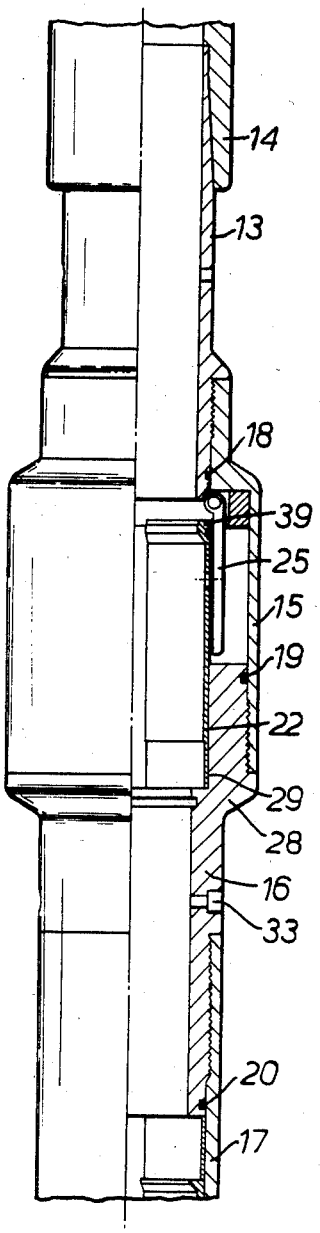
FIG. 7 is an elevation view of and partial section through the connector of FIG. 1 during the production of the well.

After the well head has been assembled, the ball 41 is dropped down tube 3 on to seat 39 and blocks the upper sleeve 22. The pressure is then increased in the space 6 within the production tube 3 in order to shear the pin 24, thus allowing the upper sleeve 22 to descend and open the flap 25 again. This upper sleeve 22 takes its place in the receptacle 29, as shown in FIG. 7. The slit 23 widens because of the elasticity of the upper sleeve 22, and the ball 41 escapes from the seat 39. The production tube 3 is then open, and the well 1 is ready for production.

The upper sleeve 22 has a sufficient length to remain held by the sheath 21 until its lower edge has reached the receptacle 29, and to continue to keep the flap 25 open when the upper sleeve is completely engaged in the receptacle 29. The inside diameter of the lower sleeve 31 in the radially expanded state in the receptacle 34 is greater than the outside diameter of the ball 41 so that the latter can leave the production tube freely.

It will be noted that the system described also has the advantage that it makes it possible to conduct a sealing test on the sub-surface safety valve 7.

Many modifications can, of course, be made to the embodiment of a connector according to the invention which has just been described, without departing from the scope of the invention.

There is thus provided a connector for a production tube whereby any use of a cable during the completion of an oil well can be avoided and thus the risks of such a use can be eliminated and the duration and cost of the completion operations can be reduced.

Additionally there is no need, during completion, to operate a circulation valve establishing communication between the annular space and the space within the production tube.

What is claimed is:

1. A connector for insertion in a production tube for use in the completion of an oil well by installation in a casing of the oil well, the production tube being provided with a sealing device, called a packer, to close the annular space between the production tube and casing, and by installation of a well head for production purposes, said connector being intended to be inserted in the production tube below the packer and comprising a first retractable ball seat which, when closed by a ball, makes it possible to admit a pressurised fluid into the inner space within the production tube and which is adapted to be moved away as a result of axial displacement and radial expansion under the action of an excess pressure in the inner space, a closing flap arranged so as to close when said first seat is moved away under the action of the said excess pressure, in order to provide a safety device during the installation of the well head, and, above said flap, a second seat which, when closed by a second ball and subjected to a pressurised fluid in the inner space, is adapted to be moved away as a result of axial displacement and radial expansion and to cause said flap to open and be maintained in the open position, in order to put the well in a state of production.

2. A connector according to claim 1, comprising, from top to bottom in the axial direction, an upper part; a radially expandable upper sleeve which is held radially compressed in said upper part and is retained vertically by at least one first shearable means; a first middle part carrying the said closing flap; a second middle part containing a receptacle for receiving said upper sleeve and allowing radial expansion of said upper sleeve; a lower part; a radially expandable lower sleeve which is held radially compressed in said lower part and is retained vertically by at least one second shearable means; and a lengthening part containing a receptacle for receiving said lower sleeve and allowing expansion of said lower sleeve; said lower sleeve, when radially compressed, providing said first seat, said upper sleeve, when radially compressed, providing said second seat which has a greater diameter than the diameter of said first seat, the presence of either said lower sleeve or said upper sleeve in said first middle part ensuring the opening of said flap, said lower sleeve extending in said first middle part when it is located in said lower part, and said upper sleeve extending in said first middle part when it is located in said second middle part.

3. A connector according to claim 2, wherein said lower sleeve and said upper sleeve are cylindrical sleeves split along a generating line.

4. A connector according to claim 2, wherein said first seat and said second seat are provided on upper portions of said lower sleeve and said upper sleeve respectively.

5. A connector according to claim 2, wherein said flap is a folding-down flap.

* * * * *